United States Patent [19]

Huffman

[11] Patent Number: 4,842,611

[45] Date of Patent: Jun. 27, 1989

[54] FLAME RETARDANT COMPOSITIONS AND PROCESS

[76] Inventor: Daniel D. Huffman, 4301 N. Vinewood, Indianapolis, Ind. 46254

[21] Appl. No.: 127,218

[22] Filed: Dec. 1, 1987

[51] Int. Cl.[4] ..... B27K 3/00; B32B 7/00

[52] U.S. Cl. ..... 8/188; 8/194; 252/7; 252/608

[58] Field of Search ..... 252/7, 608; 8/188, 194

[56] References Cited

U.S. PATENT DOCUMENTS

| | | | |
|---|---|---|---|
| 502,867 | 8/1893 | Schuler | 252/607 |
| 1,612,104 | 12/1926 | Eichengrun | 169/45 |
| 1,720,926 | 7/1929 | Shiga | 252/608 |
| 2,415,112 | 2/1947 | Seymour et al. | 117/137 |
| 3,484,372 | 12/1969 | Birchall | 252/7 |
| 3,955,987 | 5/1976 | Schaar et al. | 106/15 |
| 4,145,547 | 3/1979 | Weil | 548/320 |
| 4,184,311 | 1/1980 | Rood | 53/434 |
| 4,224,169 | 9/1980 | Retana | 252/8.1 |
| 4,448,841 | 5/1984 | Glass et al. | 428/270 |
| 4,514,327 | 4/1985 | Rock | 252/607 |

*Primary Examiner*—John F. Niebling
*Assistant Examiner*—Isabelle Rodriguez
*Attorney, Agent, or Firm*—Woodard, Emhardt, Naughton, Moriarty & McNett

[57] ABSTRACT

A flame retardant composition suitable for textile fabrics composed of natural or synthetic fibers, or blends thereof, comprising: one or more ammonium salts having flame retardant properties in admixture with a water soluble amide that thermally decomposes at temperatures below the ignition temperatures of the textile fabrics, the preferred embodiment of which is an admixture of ammonium phosphate, monobasic; ammonium phosphate, dibasic; ammonium sulphate; ammonium bromide; urea; and water; which composition can be topically applied in situ to natural or synthetic fibers, or blends thereof and dried by simple aeration to effectate flame retardability.

4 Claims, No Drawings

FLAME RETARDANT COMPOSITIONS AND PROCESS

BACKGROUND OF THE INVENTION

The present invention relates generally to the field of flame retardant compositions and more specifically to the field of flame retardant compositions for the in situ spray treatment of textiles and textile goods such as clothing fabrics, draperies, upholstery fabrics, wall coverings, carpets and the like.

The flame retardant treatment of textile fabrics composed of natural fibers (cotton, regenerated pulp, wool), synthetic fibers (polyester, nylon, acetate rayon, acrilan), or blends thereof (i.e., polyester/cotton), with specifically formulated flame retardant ammonium salt compositions or blends for each fiber type is well known in commercial textile mill practice where the expertise available allows a ready identification of the textile fiber type to be treated. It is known that natural fibers have quite different ignition and burning characteristics than synthetic fibers, and the flame retardant compositions of the prior art by which the ignition and burning of natural and synthetic fibers has been restrained in commercial textile practice has also been quite different. However, this expertise in fiber identification and selective flame retardant composition application available in commercial textile mills is not usually available beyond the commercial mills, and an effective fire retardant composition suitable for in situ application to both natural and synthetic fibers, and their blends, has not theretofore been known.

The flame retardant compositions of the present invention eliminate the need for reliance upon specific fiber identification expertise as they will effectively flame retard many types of natural and synthetic fibers, and fiber blends commonly utilized in textile and textile goods design. Furthermore, the multi-fiber flame retardant compositions of the present invention are effective after simple spray application and air drying, and unlike some flame retardant compounds used in commercial textile mill finishing, the compositions of the present invention do not require pressure impregnation nor heat curing to be effective.

SUMMARY OF THE INVENTION

One embodiment of the present invention is a flame retardant composition suitable for textile fabrics composed of natural or synthetic fibers, or blends thereof, comprising: one or more ammonium salts having flame retardant properties in admixture with a water soluble amide that thermally decomposes at temperatures below the ignition temperatures of the textile fabrics.

Another embodiment of the present invention is a flame retardant composition suitable for textile fabrics composed of natural or synthetic fibers, or blends thereof, comprising: an admixture of ammonium phosphate, monobasic; ammonium phosphate, dibasic; ammonium sulphate; ammonium bromide; urea; and water wherein the constituents of said admixture are present in about the following weight percentages; ammonium phosphate, monobasic, 2.0–3.5; ammonium phosphate, dibasic, 2.0–3.5; ammonium sulphate, 0.0–1.5; ammonium bromide, 4.0–10.0; urea, 2.0–5.0; and water, 90.0–76.5.

Another embodiment of the present invention is a process for retarding the flammability of textile fabrics composed of natural or synthetic fibers, or blends thereof, comprising: treating the fibers with an admixture of ammonium phosphate, monobasic; ammonium phosphate, dibasic; ammonium sulphate; ammonium bromide; urea; and water; and drying the fibers by aeration.

It is an object of the present invention to provide fire retardant compositions that can be used to effectively flameproof natural or synthetic fibers, as well as their blends, thereby eliminating the need to identify fabric type to select the appropriate fabric flame retardant.

It is a further object of the present invention to provide fire retardant compositions that can be used to effectively flameproof natural or synthetic fibers, as well as their blends, by topical spray application in situ followed by air drying.

It is a further object of the present invention to provide fire retardant compositions that can be used to effectively flameproof natural or synthetic fibers, as well as their blends, in situ without the need for pressure impregnation or heat treatment after topical application.

Related objects and advantages of the present invention will be apparent from the following description.

DESCRIPTION OF THE PREFERRED EMBODIMENT

The flame retardant compositions of the present invention comprise in admixture (1) an ammonium salt or mixtures of ammonium salts having well characterized flame retardant properties, such as ammonium phosphates, ammonium phosphites, soluble ammonium polyphosphates, ammonium bromide and ammonium sulfate; and (2) a water soluble amide, such as acetamide or urea, or their derivatives, which thermally decompose at temperatures below the ignition temperature of the fibers to be flame retarded. Urea has been the preferred water soluble amide in the applicants work to date.

A preferred formulation of the flame retardant of the present invention has been an admixture of the following technical grade constituents wherein the constituents are present in about the following weight percentages:

ammonium phosphate, monobasic: 2.0–3.5
ammonium phosphate, dibasic: 2.0–3.5
ammonium sulphate: 0.0–1.5
ammonium bromide: 4.0–10.0
urea: 2.5–3.0
water: 90.0–76.5

The most preferred formulation of the flame retardant of the present invention to date has been an admixture of the following technical grade constituents wherein the constituents are present in about the following weight percentages:

ammonium phosphate, monobasic: 2.5–3.0
ammonium phosphate, dibasic: 2.5–3.0
ammonium sulfate: 0.0–1.0
ammonium bromide: 6.0–8.0
urea: 2.5–3.0 1
water: 86.5–82.0

It has been surprisingly found that by careful adjustment of the blend of the constituents of the flame retardant compositions of the present invention within the paramaters of the above preferred formulations there is no need to include a strong acid to give the necessary absorption of the flame retardant compositions of the present invention to certain synthetic fibers as has been heretofore thought to be necessary.

For the purpose of promoting a better understanding and to further illustrate the present invention, reference will now be made in the Examples below to the preferred compositions of the inventions of the invention herein disclosed, but no limitation of the scope or breadth of the present invention is thereby intended by way of the presentation of these specific examples.

EXAMPLE 1

A preferred embodiment of the flame retardant composition of the present invention was prepared from the following technical grade constituents in a water-based solution wherein the constituents were present in about the following weight percentages:

ammonium phosphate, monobasic: 3.0
ammonium phosphate, dibasic: 3.0
ammonium bromide: 6.0
urea: 2.5
water: 85.5

One-half of the water constituent of the above solution was placed into a 250 gallon mixing tank and the ammonium bromide constituent was added thereto. The resulting mixture was placed under agitation for about 10 minutes after which the ammonium phosphate, monobasic, and the ammonium phosphate, dibasic, constituents were added to the resulting mixture while agitation continued. Thereafter, the ammonium sulfate and urea constituents were added while agitation continued. Finally, the remaining water constituent of the above solution was added to the resulting mixture, and agitation was continued for an additional 15 minutes.

The resulting solution was then applied by spraying onto a 5 oz. per sq. yd. 100% woven cotton fabric swatch, a 4 oz per sq. yd. 50%/50% cotton/polyester blend fabric swatch, a 2.4 oz per sq. yd. 100% polyester (sheer) fabric swatch, and a 7.2 oz per sq. yd. acetate rayon fabric swatch. After the flame retardant composition air dried on the swatches, all the swatches were subjected to and passed the following well-known industry flame tests: 1) National Fire Protection Association Standard 701 Small Scale Test Number 701 (apparatus and methods of testing therein described); New York City Board of Standards and Appeals 294,405; 2) Federal Aviation Administration 25.853b; and 3) Section 1237.1 of the State of California Administrative Code Title 19 (methods therein described).

The flame retardant treatments covered by this invention do not give a durable finish against aqueous washing. They do however have some substantivity to dry cleaning. The number of dry cleanings before loss of flame retardant properties (i.e., until they fail the relevant flame test standards) depends upon the type of fiber and the extent of absorption of the flame retardant salts into the fibers. For 100% cotton, up to 3 dry cleans can be achieved, but for 100% polyester this is reduced to 1 such cleaning.

Applicant has also determined the compositions of the present invention to be effective flame retardants for a number of natural fiberous materials, such as paper-based wall coverings, and wood, as examples.

While there has been described above the principles of this invention in connection with specific formulations, it is to be understood that this description is made only by way of example and not as a limitation on the scope of the invention.

What is claimed is:

1. A flame retardant composition suitable for in situ application to textile fabrics composed of natural or synthetic fibers, or blends thereof, and natural fibrous materials, consisting of:

an admixture of ammonium phosphate, monobasic; ammonium phosphate, dibasic; ammonium sulphate; ammonium bromide; urea; and water wherein the constituents of said admixture are present in about the following weight percentages:

ammonium phosphate, monobasic: 2.0–3.5
ammonium phosphate, dibasic: 2.0–3.5
ammonium sulphate: 0.0–1.5
ammonium bromide: 4.0–10.0
urea: 2.0–5.0
water: 90.0–76.5

2. A process for retarding the flammability of textile fabrics composed of natural or synthetic fibers, or blends thereof, and natural fibrous materials, in situ, consisting of:

treating the fibers with an admixture of ammonium phosphate, monobasic; ammonium phosphate, dibasic; ammonium sulphate; ammonium bromide; urea; and water; and drying the fibers by aeration.

3. The process of claim of claim 2 wherein said treating step includes an admixture wherein the constituents are present in about the following weight percentages:

ammonium phosphate, monobasic: 2.0–3.5
ammonium phosphate, dibasic: 2.0–3.5
ammonium sulphate: 0.0–1.5
ammonium bromide: 4.0–10.0
urea: 2.0–5.0
water: 90.0–76.5

4. The process of claim of claim 2 wherein said treating step includes topical spraying.

* * * * *

UNITED STATES PATENT AND TRADEMARK OFFICE

CERTIFICATE OF CORRECTION

PATENT NO. : 4,842,611

DATED : June 27, 1989

INVENTOR(S) : Daniel D. Huffman

It is certified that error appears in the above-identified patent and that said Letters Patent is hereby corrected as shown below:

Column 1, line 32, change "theretofore" to --heretofore".

Column 2, line 48, change "2.5-3.0" to --2.0-5.0--.

Column 2, line 59, change "2.5-3.01" to --2.5-3.0--.

Signed and Sealed this

Third Day of December, 1991

*Attest:*

HARRY F. MANBECK, JR.

*Attesting Officer*

*Commissioner of Patents and Trademarks*